US010332368B2

(12) United States Patent
Kim

(10) Patent No.: US 10,332,368 B2
(45) Date of Patent: Jun. 25, 2019

(54) EMERGENCY SIGN WITH ORIENTABLE LIGHT ASSSEMBLIES

(71) Applicant: Il Kim, Corona, CA (US)

(72) Inventor: Il Kim, Corona, CA (US)

( * ) Notice: Subject to any disclaimer, the term of this patent is extended or adjusted under 35 U.S.C. 154(b) by 335 days.

(21) Appl. No.: 15/467,849

(22) Filed: Mar. 23, 2017

(65) Prior Publication Data

US 2017/0270836 A1 Sep. 21, 2017

Related U.S. Application Data

(63) Continuation-in-part of application No. 29/594,965, filed on Feb. 23, 2017, now Pat. No. Des. 819,475, and a continuation-in-part of application No. 29/580,256, filed on Oct. 6, 2016, now Pat. No. Des. 815,692, and a continuation-in-part of application No. 29/580,249, filed on Oct. 6, 2016, now Pat. No. Des. 815,207, and a continuation-in-part of application No. 15/072,569, filed on Mar. 17, 2016, now Pat. No. 9,915,854.

(51) Int. Cl.

| | |
|---|---|
| ***F21S 9/02*** | (2006.01) |
| ***G08B 7/06*** | (2006.01) |
| ***F21V 21/30*** | (2006.01) |
| ***G09F 13/04*** | (2006.01) |

(52) U.S. Cl.

CPC ..... *G08B 7/062* (2013.01); *F21S 9/022* (2013.01); *F21V 21/30* (2013.01); *G09F 2013/0459* (2013.01)

(58) Field of Classification Search

None

See application file for complete search history.

(56) References Cited

U.S. PATENT DOCUMENTS

| | | | | |
|---|---|---|---|---|
| 5,797,673 | A * | 8/1998 | Logan | G09F 13/04 362/20 |
| 6,606,808 | B2 * | 8/2003 | Katz | G09F 13/04 362/234 |
| D495,750 | S * | 9/2004 | Lee | D20/42 |
| 6,824,295 | B1 * | 11/2004 | Grondal | G09F 13/14 362/234 |
| 7,520,072 | B2 * | 4/2009 | Yu | F21V 23/04 307/66 |

* cited by examiner

*Primary Examiner* — Britt D Hanley

(57) ABSTRACT

An emergency sign with orientable light assemblies is an apparatus that displays a message or instructions and alerts nearby individuals of an emergency or event. The apparatus includes a sign, a first orientable light assembly, and a second orientable light assembly. The first orientable light assembly and the second orientable light assembly each include a brace, a post, a sleeve, a carriage, a track, and a light fixture. The first orientable light assembly and the second orientable light are mounted onto the sign and are opposite each other about the sign. The brace positions the light fixture about the sign. The sleeve integrated into the brace and the post is rotatably connected within the sleeve so that the light fixture may spin. The carriage is terminally mounted to the post and the track is integrated into the light fixture so that the light fixture may laterally slide.

16 Claims, 9 Drawing Sheets

EMERGENCY SIGN WITH ORIENTABLE LIGHT ASSSEMBLIES

The current application claims priority to U.S. design application Ser. No. 29/580,256 filed on Oct. 6, 2016.

FIELD OF THE INVENTION

The present invention generally relates to an emergency sign. More specifically, the present invention is an emergency sign with orientable light assemblies.

BACKGROUND OF THE INVENTION

In order for public buildings to meet safety regulations, emergency signs must be installed throughout the building. Emergency signs typically illuminate or reflect light in order to present a message to nearby individuals. The illumination of emergency signs allows nearby individuals to be visually alerted regardless of the hazardous conditions. However, the range of illuminated emergency signs may be limited depending on visibility of the surrounding environment.

An objective of the present invention is to maximize the range of illumination of an emergency sign. The present invention does so with the use of orientable light assemblies. The present invention is an emergency sign with orientable light assemblies on either side of the sign which not only illuminate the surrounding area of the sign, but alert nearby individuals of an emergency or an event. The orientable light assemblies are manually operated so that an individual may direct light towards a specific path or exit. The orientable light assemblies each have a strobe light so that the present invention is sure to catch the attention of nearby individuals. Thus, the present invention is able to display a message that may provide nearby individuals with information or directions.

DETAILED DESCRIPTION OF THE INVENTION

All illustrations of the drawings are for the purpose of describing selected versions of the present invention and are not intended to limit the scope of the present invention.

Figure 1:
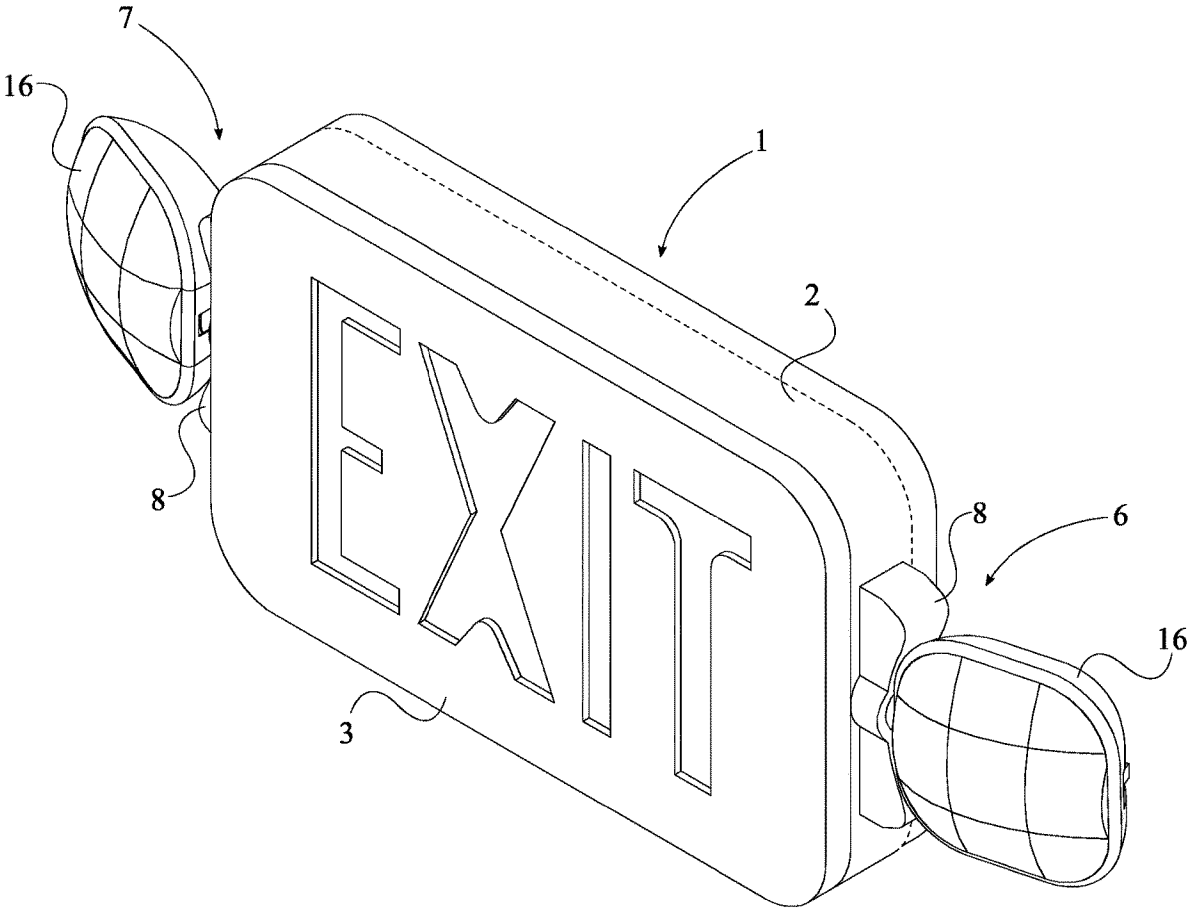
FIG. 1 is a perspective view of the preferred embodiment of the present invention.

The present invention is an emergency sign with orientable light assemblies. The present invention visually alerts individuals of an emergency. More specifically, the present invention ensures to catch the attention of nearby individuals via the orientable light assemblies. The present invention is able to visually alert individuals regardless of conditions of the surrounding environment. The present invention comprises a sign 1, a first orientable light assembly 6, and a second orientable light assembly 7, as illustrated in FIG. 1. The sign 1 displays a message to an individual. The sign 1 may alert the individuals of the current situation or direct individuals of further action. The first orientable light assembly 6 and the second orientable light assembly 7 illuminate the surrounding environment of the sign 1 so that present invention effectively catches the attention of nearby individuals. The first orientable light assembly 6 and the second orientable light assembly 7 also amplifies the illumination of the present invention so that nearby individuals may better maneuver in the surrounding area. The present invention informs and alerts individuals in the event of an emergency.

The first orientable light assembly 6 and the second orientable light assembly 7 extend the range of illumination so that individuals positioned at certain distances from the present invention are quickly alerted. The first orientable light assembly 6 and the second orientable light assembly 7 each comprise a brace 8, a post 9, a sleeve 19, an incremental interface 11, a carriage 14, a track 15, and a light fixture 16, as shown in FIG. 1, FIG. 3, FIG. 5, and FIG. 6. The light fixture 16 illuminates a specific area around the present invention. The brace 8 positions the light fixture 16 onto the sign 1. The post 9 allows the light fixture 16 to completely rotate about the sleeve 19, which is housed within the brace 8. The incremental interface 11 allows the orientation of the light fixture 16 about the sleeve 19 to be incrementally adjusted by an individual. The carriage 14 connects the light fixture 16 to the post 9. The carriage 14 allows the light fixture 16 to move along the track 15, which further extends the range of illumination of the present invention.

Figure 2:
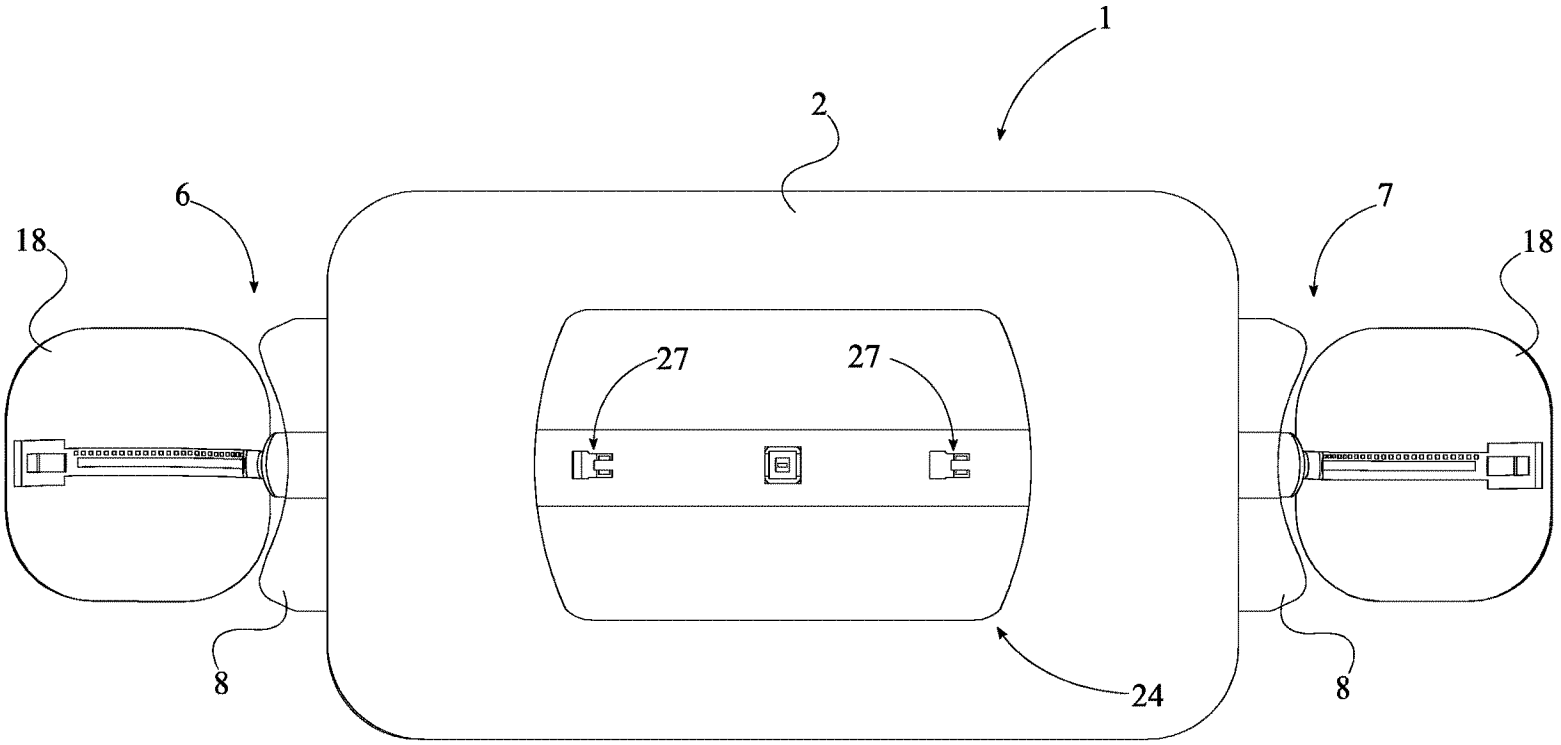
FIG. 2 is a rear view of an embodiment of the present invention, wherein the planar mount is connected to the sign.
Figure 4:
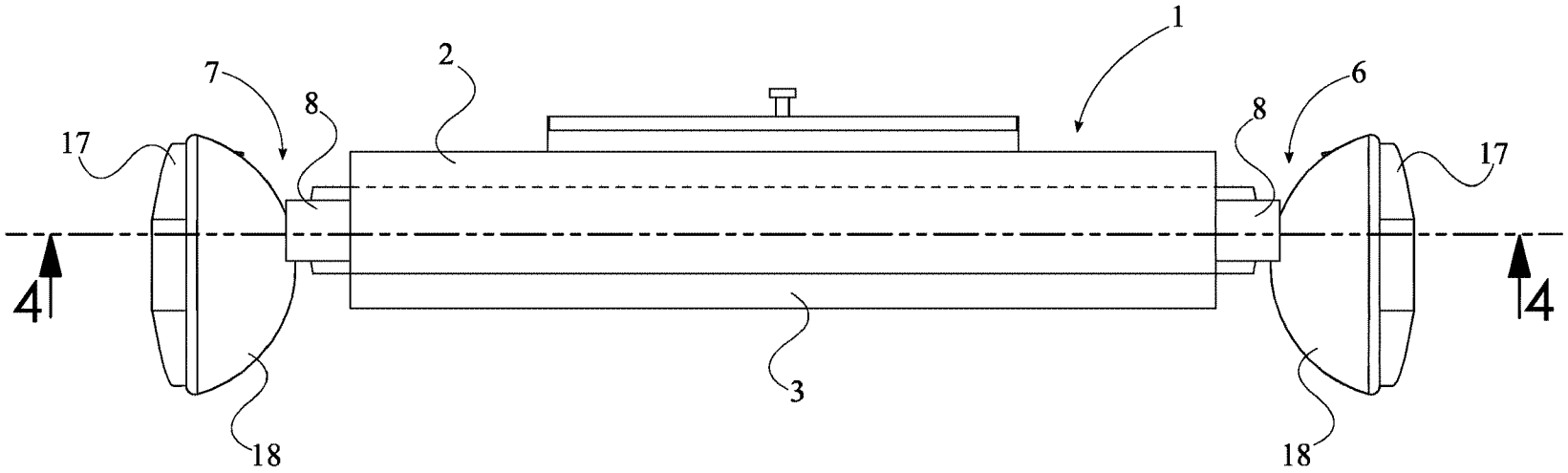
FIG. 4 is a top view of an embodiment of the present invention, wherein the planar mount is connected to the sign.
Figure 5:
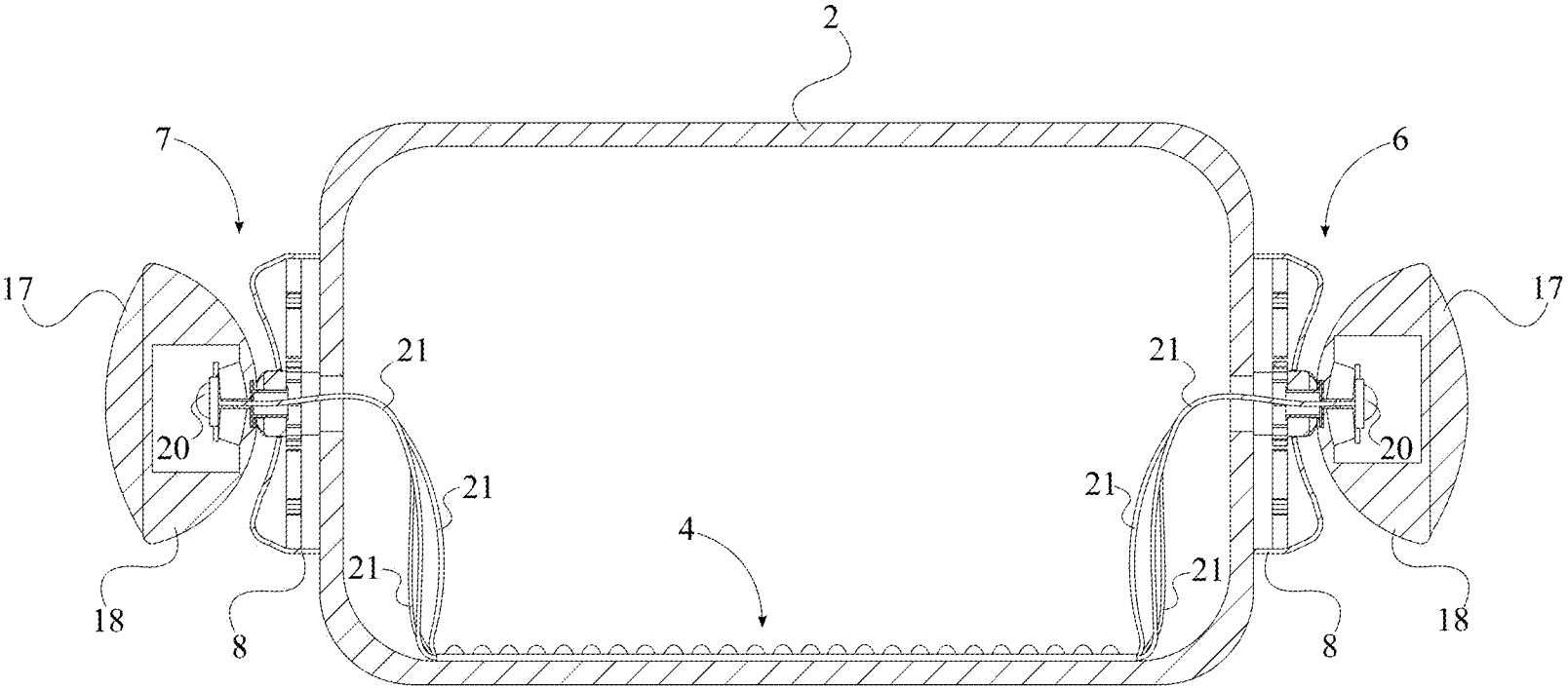
FIG. 5 is a cross-section view of FIG. 3 of the present invention.

The overall configuration of the aforementioned components allows the present invention to maximize the range of illumination of the surrounding area. The first orientable light assembly 6 is mounted adjacent to the sign 1, and the second orientable light assembly 7 is mounted adjacent to the sign 1, opposite the first orientable light assembly 6, as shown in FIG. 2, FIG. 4, and FIG. 5. The opposing positions of the first orientable light assembly 6 and the second orientable light assembly 7 allows the present invention to extend the range of illumination about the sign 1. The first orientable light assembly 6 and the second orientable light assembly 7 mirror each other about the sign 1. More specifically, the brace 8 is peripherally attached to the sign 1 so that the light fixture 16 may be accessed by an individual. The sleeve 19 is integrated into the brace 8, and the post 9 is rotatably and terminally connected within the sleeve 19 so that the rotation of the light fixture 16 is not limited by the brace 8. The incremental interface 11 is mechanically integrated into the rotatable connection between the post 9 and the sleeve 19 so that the desired orientation of the light fixture 16 is maintained, unless altered by an individual. In the preferred embodiment of the present invention, the incremental interface 11 comprises a first set of ridges 12 and a second set of ridges 13. The first set of ridges 12 is internally mounted around the sleeve 19, and the second set of ridges 13 is externally mounted around the post 9. The first set of ridges 12 and the second set of ridges 13 are ratchetably engaged to each other, preventing the unwanted movement of the post 9 about the sleeve 19.

Moreover, the carriage 14 is terminally mounted to the post 9, opposite the sleeve 19 so that the movement of the light fixture 16 is not limited by the brace 8. The track 15 is integrated into the light fixture 16, and the carriage 14 is slidably engaged with the track 15 so that the light fixture 16 may be oriented in a variety of positions.

Figure 3:
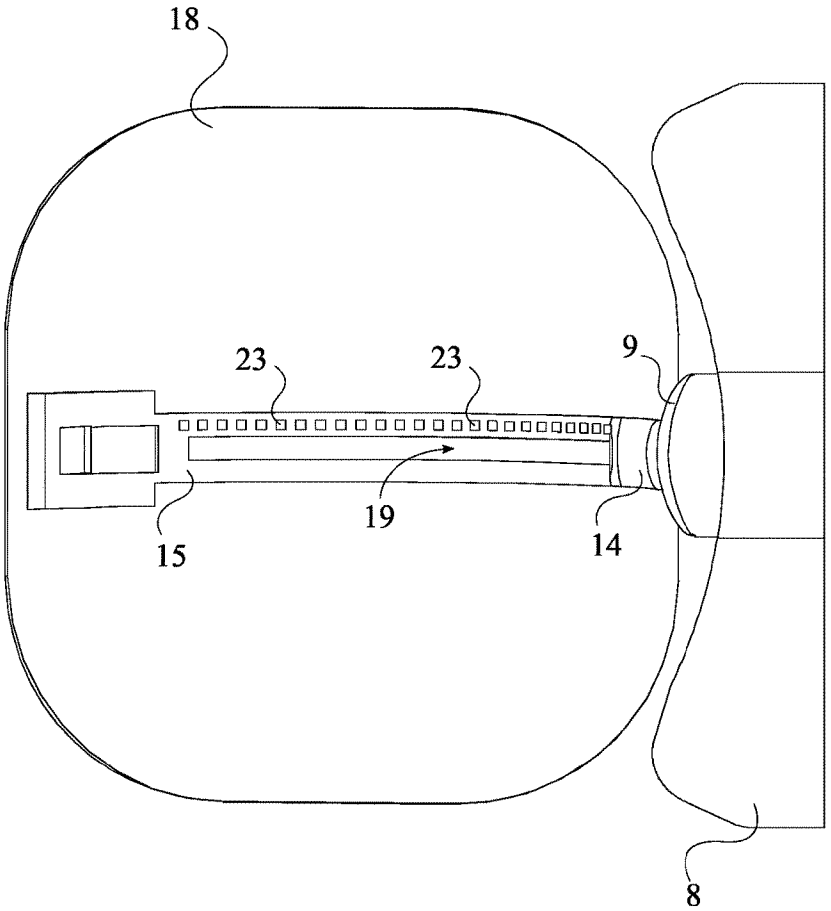
FIG. 3 is a rear view of a light fixture of the present invention.

In order to provide illumination, the light fixture 16 comprises a transparent cap 17, a casing 18, a slot 19, and an emergency light source 29. The components of the light fixture 16 are shown in FIG. 3 and FIG. 5. The transparent cap 17 allows the light from the emergency light source 29 to traverse through the casing 18. The casing 18 prevents the emergency light source 29 from being damaged from any hazardous conditions of the surrounding environment. The slot 19 allows the emergency light source 29 to connect to the sign 1. In order for the emergency light source 29 to be housed and protected from surrounding elements, the casing 18 is peripherally connected around the transparent cap 17. The emergency light source 29 is mounted in between the transparent cap 17 and the casing 18 so that the light of the emergency light source 29 is directed towards the transparent cap 17. The emergency light source 29 is preferably a strobe light so that the orientable light assembles capture the attention of nearby individuals in all circumstances. The track 15 is externally integrated about the casing 18, which allows the carriage 14 to follow the track about the casing 18. The slot 19 traverses into the casing 18 and through the track 15 so that the emergency light source 29 remains electrically connected to the sign 1 regardless of both the position and movement of the light fixture 16 about the track 15.

Figure 9:
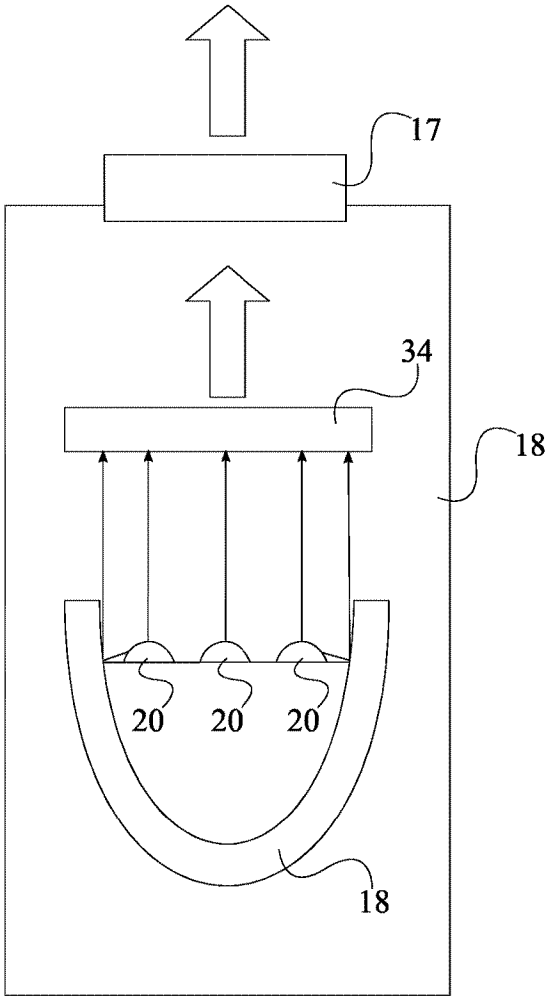
FIG. 9 is a schematic view of the optical communication between the emergency light source and the transparent cap of the present invention.

In the preferred embodiment of the present invention, the light fixture 16 further comprises a reflector 33 and a diffuser 34. The reflector 33 directs the light, and the diffuser 34 is used to convert the light from the emergency light source 29 into soft light. The reflector 33 and the diffuser 34 are mounted within the casing 18, and the emergency light source 29 is positioned between the reflector 33 and the transparent cap 17, as shown in FIG. 9. This configuration allows all the light from the emergency light source 29 to be directed towards the transparent cap 17. The emergency light source 29 and the transparent cap 17 are in optical communication with each other through the diffuser 34 such that the light that exits the light fixture 16 through the transparent cap 17 is evenly distributed across the transparent cap 17.

In order to transfer electrical power from the sign 1 to the light fixture 16, both the first orientable light assembly 6 and the second orientable light assembly 7 further comprises a plurality of electrical wires 21. The emergency light source 29 is electrically connected to the sign 1 by the plurality of electrical wires 21 so that the activation of the light fixture 16 is in unison with the activation of the sign 1. The plurality of electrical wires 21 traverses from the casing 18, through the slot 19, through the carriage 14, through the post 9, and into the sign 1. This arrangement allows the emergency light source 29 to remain connected to the sign 1 as the casing 18 moves about the track 15 and as the post 9 rotates about the sleeve 19.

Figure 6:
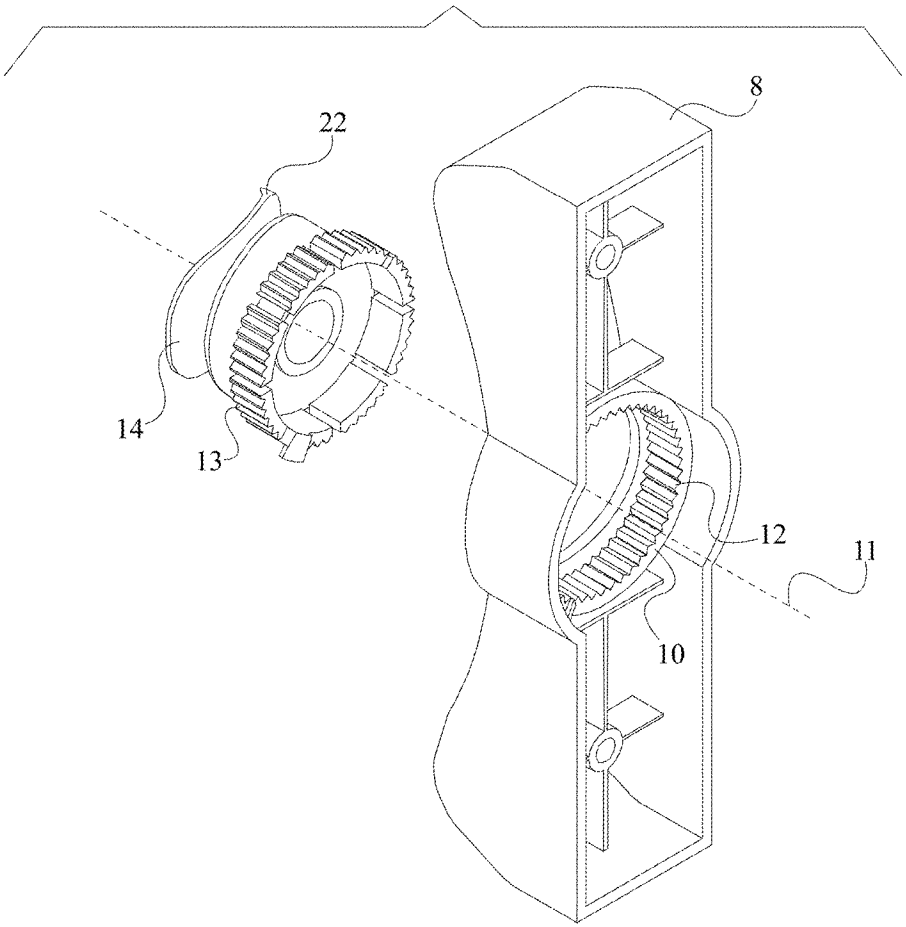
FIG. 6 is an exploded view of the brace, the post, the sleeve, the incremental interface, the carriage, and the track of the present invention.

In order to secure the desired position of the carriage 14 along the track 15, both the first orientable light assembly 6 and the second orientable light assembly 7 further comprises a pawl 22 and a plurality of ratcheting teeth 23. The pawl 22, as shown in FIG. 6, prevents the carriage 14 from sliding past a tooth of the plurality of ratcheting teeth 23 unless purposefully moved by an individual. The plurality of ratcheting teeth 23, as shown in FIG. 3, orients the casing 18 about the carriage 14. The plurality of ratcheting teeth 23 is connected along and onto the track 15, and the pawl 22 is mounted onto the carriage 14, opposite to the post 9, thereby preventing the carriage 14 from slipping along the track 15. More specifically, the pawl 22 engages to the plurality of ratcheting teeth 23 such that the carriage 14 moves along the track 15 only if an individual manually forces the pawl 22 across the plurality of ratcheting teeth 23.

Figure 7:
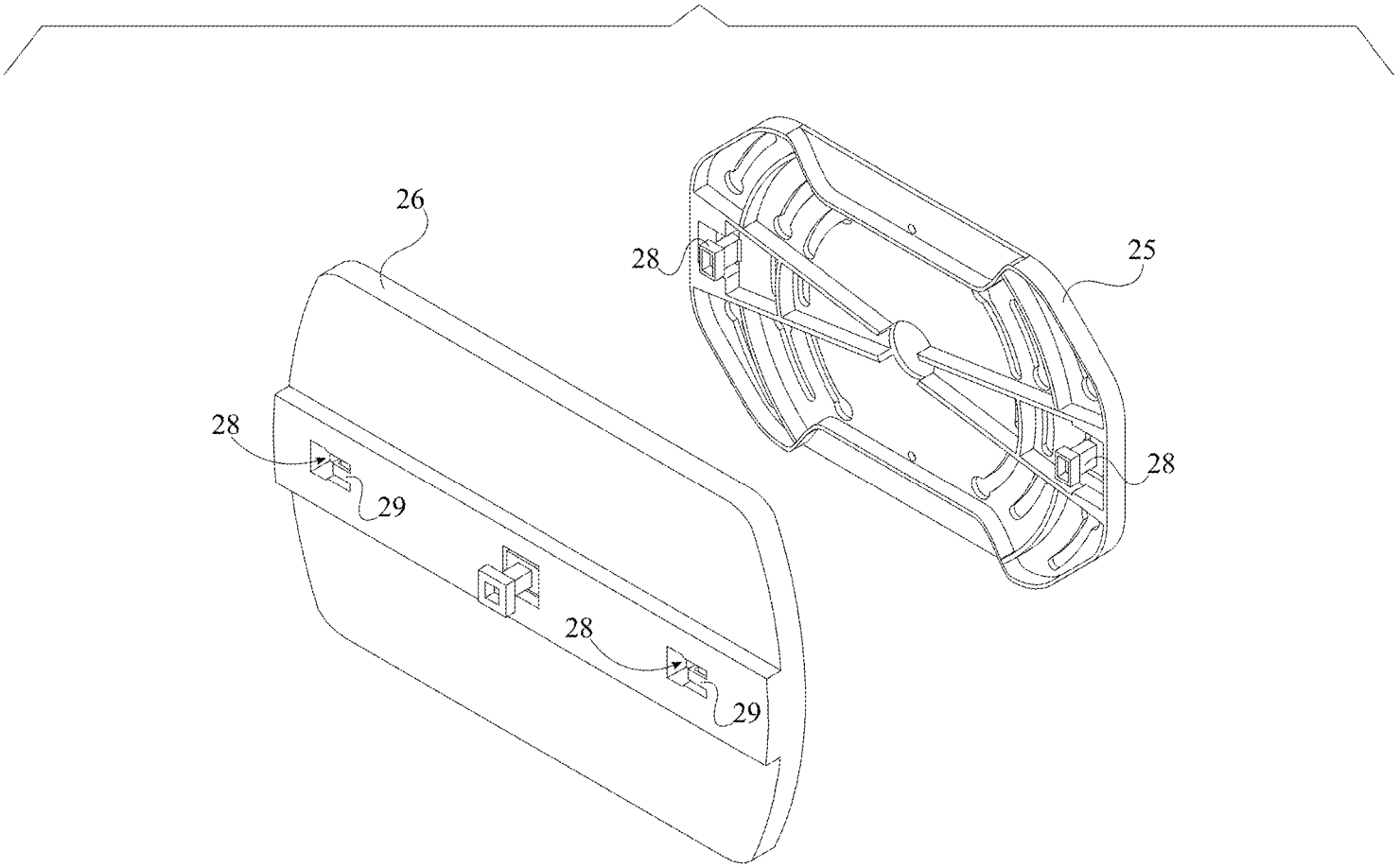
FIG. 7 is an exploded view of the planar mount of the present invention, wherein the adapter plate is disconnected from the connecting plate.

The present invention is preferably fastened onto a wall so that the present invention is visible by many individuals. A planar mount 24 attaches the sign 1 onto a wall, as shown in FIG. 2. The planar mount 24 comprises an adapter plate 25 and a connecting plate 26. The sign 1 is detachably attached to the adapter plate 25, and the adapter plate 25 is detachably attached to the connecting plate 26, as shown in FIG. 7. The engagement between the adapter plate 25 and the connecting plate 26 allows an individual to securely mount the sign 1 onto the wall while allowing the individual to access the sign 1 and the first orientable light assembly 6 and the second orientable light assembly 7. The connecting plate 26 is preferably to a wall via a plurality of screw, a plurality of bolts, or a variety of comparable fasteners.

In the preferred embodiment of the present invention, the plurality of fastening mechanisms 27 allows an individual to easily connect and disconnect the adapter plate 25 to the connecting plate 26. The plurality of fastening mechanisms 27 is distributed across the planar mount 24, as shown in FIG. 7. More specifically, each of the plurality of fastening mechanisms 27 comprises a clip-receiving hole 29, a clip-locking tab 30, and a snap clip 28. The clip-receiving hole 29 traverses normal and through the connecting plate 26 so that the snap clip 28 may traverse through the connecting plate 26. The clip-locking tab 30 is fixed to the connecting plate 26 and traverses into the clip-receiving hole 29 so that the snap clip 28 is secured within the clip-receiving hole 29. The snap clip 28 is mounted normal and onto the adapter plate 25. The snap clip 28 is positioned into the clip-receiving hole 29 and is engaged by the clip-locking tab 30, so that the adapter plate 25 is secured to the planar mount 24. More specifically, the engagement between the snap clip 28 and the clip-locking tab 30 secures the adapter plate 25 onto the planar mount 24.

Figure 8:
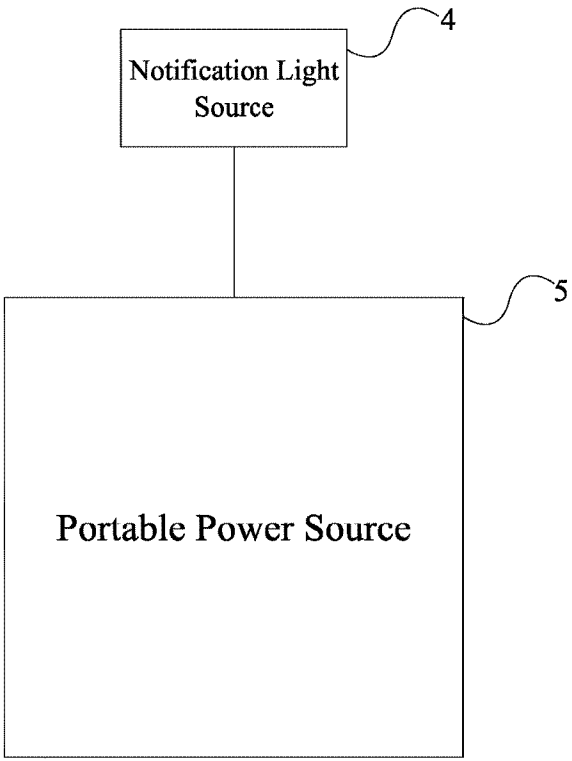
FIG. 8 is a schematic view of the electric connection between the notification light source and the portable power source of the present invention.

In preferred embodiment of the present invention, the sign 1 comprises a housing 2, a display cover 3, and a notification light source 4, as shown in FIG. 4 and FIG. 5. The housing 2 contains the notification light source 4 and the plurality of electrical wires 21 of the first orientable light assembly 6 and the second orientable light assembly 7. The housing 2 effectively contains these components as the housing 2 is peripherally attached around the display cover 3. The display cover 3 presents message or symbol and allows the illumination of the notification light source 4 to traverse through the sign 1. The notification light source 4 is mounted in between the display cover 3 and the housing 2 so that, the notification light source 4 illuminates a message or symbol on the display cover 3 so that the message or symbol is visible to an individual in a variety of conditions. In order to illuminate the message or symbol, the sign 1 further comprises a portable power source 5. The portable power source 5 delivers the necessary power to the electric components of the present invention. More specifically, the notification light source 4 is electrically connected to the portable power source 5, as shown in FIG. 8. The portable power source 5 may comprise an on-and-off switch that is integrated into the exterior of the sign 1 so that an individual may manually turn on or turn off the notification light source 4. The portable power source 5 is preferably at least one battery. More specifically, the portable power source 5 comprises a main battery and an emergency battery. The main battery delivers the power to the notification light source 4 throughout the use of the present invention, and the emergency battery delivers power to the notification light source 4 once the main battery is depleted. The portable power source 5 may further comprise a test switch that tests the functionality of the portable power source. The test switch interrupts the electrical current from the portable power source. More specifically, upon the activation of the test switch, the test switch interrupts the electrical current from the main battery so that the emergency battery may deliver power to the notification light source 4. An individual may access the at least one battery upon the separation of the housing 2 from the display cover 3.

Although the invention has been explained in relation to its preferred embodiment, it is to be understood that many other possible modifications and variations can be made without departing from the spirit and scope of the invention as hereinafter claimed.

What is claimed is:

1. An emergency sign with orientable light assemblies comprises:

a sign;

a first orientable light assembly;

a second orientable light assembly;

the first orientable light assembly and the second orientable light assembly each comprise a brace, a post, a sleeve, an incremental interface, a carriage, a track, and a light fixture;

the first orientable light assembly being mounted adjacent to the sign;

the second orientable light assembly being mounted adjacent to the sign, opposite the first orientable light assembly;

the brace being peripherally attached to the sign;

the sleeve being integrated into the brace;

the post being rotatably and terminally connected within the sleeve;

the incremental interface being mechanically integrated into the rotatable connection between the post and the sleeve;

the carriage being terminally mounted to the post, opposite the sleeve;

the track being integrated into the light fixture; and the carriage being slidably engaged with the track.

2. The emergency sign with orientable light assemblies as claimed in claim 1 comprises:

the light fixture comprises a transparent cap, a casing, a slot, and an emergency light source;

the casing being peripherally connected around the transparent cap;

the emergency light source being mounted in between the transparent cap and the casing;

the track being externally integrated about the casing; and the slot traversing into the casing and through the track.

3. The emergency sign with orientable light assemblies as claimed in claim 2 comprises:

the light fixture further comprises a reflector and a diffuser;

the reflector and the diffuser being mounted within the casing;

the emergency light source being positioned between the reflector and the transparent cap; and, the emergency light source and the transparent cap being in optical communication with each other through the diffuser.

4. The emergency sign with orientable light assemblies as claimed in claim 2 comprises:

the first orientable light assembly and the second orientable light assembly each further comprises a plurality of electrical wires;

the plurality of electrical wires traversing from the casing, through the slot, through the carriage, through the post, and into the sign; and the emergency light source being electrically connected to the sign by the plurality of electrical wires.

5. The emergency sign with orientable light assemblies as claimed in claim 2 comprises:

the first orientable light assembly and the second orientable light assembly each further comprises a pawl and a plurality of ratcheting teeth;

the plurality of ratcheting teeth being connected along and onto the track;

the pawl being mounted onto the carriage, opposite to the post; and the pawl being engaged to the plurality of ratcheting teeth.

6. The emergency sign with orientable light assemblies as claimed in claim 1 comprises:

a planar mount;

the planar mount comprises an adapter plate and a connecting plate;

the sign being detachably attached to the adapter plate; and the adapter plate being detachably attached to the connecting plate.

7. The emergency sign with orientable light assemblies as claimed in claim 5 comprises:

a plurality of fastening mechanisms;

each of the plurality of fastening mechanism comprises a snap clip, a clip-receiving hole, and a clip-locking tab;

the plurality of fastening mechanism being distributed across the planar mount;

the clip-receiving hole traversing normal and through the connecting plate;

the clip-locking tab being fixed to the connecting plate;

the clip-locking tab traversing into the clip-receiving hole;

the snap clip being mounted normal and onto the adapter plate;

the snap clip being positioned into the clip-receiving hole; and the snap clip being engaged by the clip-locking tab.

8. The emergency sign with orientable light assemblies as claimed in claim 1 comprises:

the sign comprises a housing, a display cover, and a notification light source;

the housing being peripherally attached around the display cover; and the notification light source being mounted in between the display cover and the housing.

9. The emergency sign with orientable light assemblies as claimed in claim 7 comprises:

the sign further comprises a portable power source; and the notification light source being electrically connected to the portable power source.

10. The emergency sign with orientable light assemblies as claimed in claim 1 comprises:

the incremental interface comprises a first set of ridges and a second set of ridges;

the first set of ridges being internally mounted around the sleeve;

the second set of ridges being externally mounted around the post; and the first set of ridges and the second set of ridges being ratchetably engaged to each other.

11. An emergency sign with orientable light assemblies comprises:

a sign;

a first orientable light assembly;

a second orientable light assembly;

the first orientable light assembly and the second orientable light assembly each comprise a brace, a post, a sleeve, an incremental interface, a carriage, a track, and a light fixture;

the light fixture comprises a transparent cap, a casing, a slot, and an emergency light source;

the first orientable light assembly being mounted adjacent to the sign;

the second orientable light assembly being mounted adjacent to the sign, opposite the first orientable light assembly;

the brace being peripherally attached to the sign;

the sleeve being integrated into the brace;

the post being rotatably and terminally connected within the sleeve;

the incremental interface being mechanically integrated into the rotatable connection between the post and the sleeve;

the carriage being terminally mounted to the post, opposite the sleeve;

the track being integrated into the light fixture;

the carriage being slidably engaged with the track;

the casing being peripherally connected around the transparent cap;

the emergency light source being mounted in between the transparent cap and the casing;

the track being externally integrated about the casing; and the slot traversing into the casing and through the track.

12. The emergency sign with orientable light assemblies as claimed in claim 2 comprises:

the first orientable light assembly and the second orientable light assembly each comprises a plurality of electrical wires;

the plurality of electrical wires traversing from the casing, through the slot, through the carriage, through the post, and into the sign; and the emergency light source being electrically connected to the sign by the plurality of electrical wires.

13. The emergency sign with orientable light assemblies as claimed in claim 2 comprises:

the first orientable light assembly and the second orientable light assembly each further comprises a pawl and a plurality of ratcheting teeth;

the plurality of ratcheting teeth being connected along and onto the track;

the pawl being mounted onto the carriage, opposite to the post; and the pawl being engaged to the plurality of ratcheting teeth.

14. The emergency sign with orientable light assemblies as claimed in claim 1 comprises:

a planar mount;

the planar mount comprises an adapter plate and a connecting plate;

the sign being detachably attached to the adapter plate;

the adapter plate being detachably attached to the connecting plate;

a plurality of fastening mechanisms;

each of the plurality of fastening mechanism comprises a snap clip, a clip-receiving hole, and a clip-locking tab;

the plurality of fastening mechanism being distributed across the planar mount;

the clip-receiving hole traversing normal and through the connecting plate;

the clip-locking tab being fixed to the connecting plate;

the clip-locking tab traversing into the clip-receiving hole;

the snap clip being mounted normal and onto the adapter plate;

the snap clip being positioned into the clip-receiving hole; and the snap clip being engaged by the clip-locking tab.

15. The emergency sign with orientable light assemblies as claimed in claim 1 comprises:

the sign comprises a housing, a display cover, and a notification light source;

the housing being peripherally attached around the display cover;

the notification light source being mounted in between the display cover and the housing;

the sign further comprises a portable power source; and the notification light source being electrically connected to the portable power source.

16. The emergency sign with orientable light assemblies as claimed in claim 1 comprises:

the incremental interface comprises a first set of ridges and a second set of ridges;

the first set of ridges being internally mounted around the sleeve;

the second set of ridges being externally mounted around the post; and the first set of ridges and the second set of ridges being ratchetably engaged to each other.

* * * * *